US005429725A

United States Patent [19]

Thorpe et al.

[11] Patent Number: 5,429,725

[45] Date of Patent: Jul. 4, 1995

[54] AMORPHOUS METAL/METALLIC GLASS ELECTRODES FOR ELECTROCHEMICAL PROCESSES

[76] Inventors: Steven J. Thorpe, 184 College Street; Donald W. Kirk, 200 College Street, both of Toronto, Ontario, Canada, M5S 1A4

[21] Appl. No.: 307,070

[22] Filed: Sep. 16, 1994

[30] Foreign Application Priority Data

Jun. 17, 1994 [CA] Canada ..... 2126136

[51] Int. Cl.[6] ..... C25B 1/02; C25B 11/06; H01F 1/04

[52] U.S. Cl. ..... 204/129; 204/291; 204/293; 148/304; 148/403

[58] Field of Search ..... 148/304, 403; 204/291, 204/293, 292, 129

[56] References Cited

U.S. PATENT DOCUMENTS

| | | | |
|---|---|---|---|
| 4,152,144 | 5/1979 | Hasegawa et al. | 148/304 |
| 4,544,437 | 10/1985 | Oyshinsky et al. | 204/292 |
| 4,545,883 | 10/1985 | Ovshinsky | 204/292 |
| 4,560,454 | 12/1985 | Harris et al. | 148/403 |
| 4,637,967 | 1/1987 | Keem et al. | 429/101 |
| 4,782,994 | 11/1988 | Ragbould et al. | 148/403 |
| 5,213,907 | 5/1993 | Caballero | 428/678 |
| 5,284,528 | 2/1994 | Hasegawa et al. | 148/304 |
| 5,314,608 | 5/1994 | Caballero | 205/238 |

*Primary Examiner*—John Niebling
*Assistant Examiner*—Bruce F. Bell
*Attorney, Agent, or Firm*—Cushman, Darby & Cushman

[57] ABSTRACT

Metallic glass / amorphous metal electrodes produced by rapid solidification (i) having a structure that is either amorphous or nanocrystalline, (ii) containing the principal alloying element as Ni, (iii) containing alloying conditions of Co and Mo in the range of 0 to 8 at . %, and when combined with NI, represent 0.75 to 0.85 of the atomic fraction of the alloy, and (iv) containing metalloid elements comprised of one or more of the elements C,B,Si and P either singly or in combination to represent 0.15 to 0.25 atomic faction of the alloy. The electrodes have excellent thermal stability, improved stability in an aqueous electrolyte and can provide improved current efficiency—anodic overpotential performance. They are used in the electrolysis of aqueous electrolyte solutions such as mixtures of caustic and water in the production of oxygen and hydrogen.

13 Claims, 4 Drawing Sheets

AMORPHOUS METAL/METALLIC GLASS ELECTRODES FOR ELECTROCHEMICAL PROCESSES

FIELD OF THE INVENTION

This invention relates to an improved electrode material for use in electrochemical processes and particularly an amorphous metal/metallic glass electrode material intended for constituting the active surface of an electrode for use in the electrolysis of aqueous solutions and more particularly in the electrochemical production of oxygen and hydrogen by said electrolysis.

BACKGROUND OF THE INVENTION

In electrolytic cells for the production of hydrogen and oxygen, such as those of the bipolar and unipolar type, an aqueous caustic solution is electrolyzed to produce oxygen at the anode and hydrogen at the cathode with the overall reaction being the decomposition of water to yield hydrogen and oxygen. The products of the electrolysis are maintained separate by use of a membrane/separator. Use of amorphous metals/metallic glasses and nanocrystalline materials as electrocatalysts for the hydrogen and oxygen evolution reaction are known. The terms "amorphous metal" or "metallic glass" are well understood in the art and define a material which contains no long range structural order but can contain short range structure and chemical ordering. Henceforth, in this specification and claims both terms will be used as being synonymous and are interchangeable. The term "nanocrystalline" refers to a material which possesses a crystallite grain size of the order of a few nanometers, i.e. the crystalline components have a grain size of less than about 10 nanometers. Further, the term "metallic glass" embraces such nanocrystalline materials in this specification and claims.

Numerous nickel-chromium alloys containing additives of other metals or metalloids are known wherein the chromium is provided to enhance corrosion resistance. However, such materials have limited utility in electrocatalysis.

The electrocatalytic behaviour of alloys made by combinations of the two elements Mo and Co to a Ni-base metallic glass have not been reported, although the additions of both Co and Mo to crystalline Ni have shown improved catalytic performance. The reason might be that Mo, when combined with Ni in a crystalline alloy is unstable in alkaline solutions and such alloys undergo preferential dissolution of the Mo constituent (8).

In an electrolysis application, not all of the current which is passed through the cell during electrolysis is utilized in the production of hydrogen and oxygen. This loss of efficiency of the cell is often referred to as the cell overpotential required to allow the reaction to proceed at the desired rate and is in excess of the reversible thermodynamic decomposition voltage. This cell overpotential can arise from: (i) reactions occurring at either the cathode or the anode, (ii) a potential drop because of the solution ohmic drop between the two electrodes, or (iii) a potential drop due to the presence of a membrane / separator material placed between the anode and cathode. The latter two efficiencies are fixed by the nature of the cell design while (i) is directly a result of the activity of the electrode material employed in the cell including any activation or pretreatment steps. Performance of an electrode is then directly related to the overpotentials observed at both the anode and cathode through measurement of the Tafel slope and the exchange current density (hereinafter explained).

Superior electrode performance for the electrolysis of water may be achieved by the use of platinum group metals, alloys and compounds. However, it is desirable to obtain an alloy free of any platinum group metal constituents because of the relatively high cost of all of the platinum group metals. A desirable alternative would then be an alloy comprised of more economical constituents which would still provide the same operating characteristics of a low voltage, high current cell behaviour corresponding to the evolution of hydrogen or oxygen while being electrochemically stable in the alkaline solution.

REFERENCE LIST

The present specification refers to the following publications, each of which is expressly incorporated herein by reference.

PUBLICATIONS

1. Lian, K. Kirk, D. W. and Thorpe, S. J., "Electrocatalytic Behaviour of Ni-base Amorphous Alloys", Electrochim. Acta, 36, p. 537–545, (1991)
2. Kreysa, G. and Hakansson, "Electrocatalysis by Amorphous Metals of Hydrogen and Oxygen Evolution in Alkaline Solution", J. Electroanal. Chem., 201, p. 61–83, (1986).
3. Podesta, J. J., Piatti; R. C. V., Arvia, A. J., Ekdunge, P., Juttner, K. and Kreysa, G., "The Behaviour of Ni—Co—P base Amorphous Alloys for Water Electrolysis in Strongly Alkaline Solutions Prepared through Electroless Deposition", Int. J. Hydrogen Energy, 17, p. 9–22, (1992).
4. Alemu, H. and Juttner, K., "Characterization of the Electrocatalytic Properties of Amorphous Metals for Oxygen and Hydrogen Evolution by Impedance Measurements", Electrochim. Acta., 33, p. 1101–1109, (1988).
5. Huot, J.-Y., Trudeau, M., Brossard, L. and Schultz, R. "Electrochemical and Electrocatalytic Behaviour of an Iron Base Amorphous Alloy in Alkaline Solution at 70° C.", J. Electrochem. Soc., 136, p. 2224–2230, (1989).
6. Vracar, Lj., and Conway, B. E., "Temperature Dependence of Electrocatalytic Behaviour of Some Glassy Transition Metal Alloys for Cathodic Hydrogen Evolution in Water Electrolysis", Int. J. Hydrogen Energy, 15, p. 701–713 (1990).
7. Wilde, B. E., Manohar, M., Chattoraj, I., Diegle, R. B. and Hays, A. K., "The Effect of Amorphous Nickel Phosphorous Alloy Layers on the Absorption of Hydrogen into Steel", Proc. Symp. Corrosion, Electrochemistry and Catalysis of Metallic Glasses, 88-1, Ed. R. B. Diegle and K. Hashimoto, Electrochemical Society, Pennington, p. 289–307 (1988).
8. J. Divisek, H. Schmitz and J. Balej, J. of Applied Electrochemistry, 19, p. 519–530, (1989).

SUMMARY OF THE INVENTION

It is an object of this invention to provide an improved electrode having an electrochemically active surface which can be used for the electrolysis of water.

It is a further object of this invention to provide an improved electrode which is chemically stable in an alkaline environment for both static and dynamic cycling operations of the cell.

It is a further object of the present invention to provide an improved electrode material that is sufficiently active so as to reduce either or both the anodic overpotential for oxygen evolution or the cathodic overpotential for hydrogen evolution.

It is a further object to provide an electrode which contains relatively inexpensive elemental constituents compared to the platinum group metals.

It is a further object to provide an electrode whose total processing operations necessary to final electrode fabrication are minimized in comparison to conventional electrode materials.

It is a further object to provide an electrode which can be operated at elevated temperatures in an alkaline environment to provide enhanced performance since the overpotential required to produce either hydrogen or oxygen is reduced as the operational temperature of the cell is increased.

Accordingly, the invention provides in one aspect a metallic glass of use in electrochemical processes, said metallic glass consisting essentially of a material of the general nominal composition $$Ni_{72}\ CO_{8x}\ Mo_x\ Z_{20}$$

wherein x is 0,2,4 or 6 atomic % and

Z is a metalloid element.

Preferably, x is 2, 4 or 6 atomic %.

Metalloid elements of use in the invention comprise, for example, silicon, phosphorus, carbon, and, preferably, boron.

The metallic glass is most preferably in an elemental and homogenous state but some degree of non-homogeneity in both anionic and cationic form can be tolerated.

It will be understood that the general formula defined hereinabove represents a nominal composition and thus allows of some degree of variance from the exact atomic ratios shown.

A most preferred material according to the invention has the nominal composition of $Ni_{72}\ Mo_8\ B_{20}$.

The alloys of the present invention are readily made into self supporting structures.

In a further aspect the invention provides an electrode of use in an electrochemical cell comprising a metallic glass consisting of a material as hereinabove defined. The electrode may act as either an anode, cathode or both as a working electrode. The materials of the invention may constitute a full electrode or a surface coating on a substrate such as a metal or other electrically conductive material.

In a yet further aspect, the invention provides an improved process for the electrochemical production of oxygen and hydrogen from an aqueous solution in an electrochemical cell, said process comprising electrolysing said aqueous solution with electrodes, said improvement comprising one or more of said electrodes comprising a metallic glass consisting essentially of a material as hereinabove defined.

In the electrolytic production of oxygen and hydrogen, the aqueous solution is alkaline.

Surprisingly, the metallic glasses according to the invention do not suffer from the loss of Mo during use and retain electrolytic activity under severe conditions of use. Thus, we have found that the presence of molybdenum in the alloys of the invention, while providing the unexpected advantages hereindescribed, surprisingly, does not result in dissolution of the molybdenum under alkaline electrolysis conditions.

Thus, the invention provides a metallic glass / amorphous metal electrode material for electrochemical processes produced by rapid solidification (i) having a structure that is either amorphous or nanocrystalline, (ii) containing the principal alloying element as Ni, (iii) containing alloying additions of Co and Mo in the range of 0 to 8 at. %, and when combined with Ni, represent 0.75 to 0.85 of the atomic fraction of the alloy, and (iv) containing metalloid elements comprised of one or more of the elements C, B, Si and P either singly or in combination to represent 0.15 to 0.25 atomic fraction of the alloy. The electrodes have excellent thermal stability, improved stability in an aqueous electrolyte and can provide improved current efficiency—anodic overpotential performance. They are of use in the electrolysis of aqueous electrolyte solutions such as mixtures of caustic (KOH, NaOH) and water in the production of oxygen and hydrogen.

The electrodes are comprised of low cost transition metals in combination with metalloid elements in specific ratios to permit the alloy composition to be solidified into an amorphous state and are free of any platinum group metals. They offer improved current efficiencies via anodic or cathodic overpotential performance and offer improved stability in both static and cyclic exposures. They can be used in concentrated alkaline solutions and at elevated temperatures for improved electrode performance. The electrodes are of use in the electrolysis of alkaline solutions resulting in the production of hydrogen and oxygen via the decomposition of water, and also additional uses in electrodes for fuel cells, electro-organic synthesis or environmental waste treatment.

Processing methodology of rapid solidification offers many cost advantages compared to the preparation of conventional Raney Ni type electrodes. The process is a single step process from liquid metal to finished catalyst which can be fabricated in the form of ribbons or wires for weaving into a mesh grid. The process can also be used to produce powders, flakes, etc. which can further be consolidated into a desired shape. By comparison, conventional electrode fabrication involves the production of a billet or rod, wire drawing and annealing operations, weaving to form a wire mesh grid, surface treatment, powder deposition, powder consolidation and an activation step.

Table 1 summarizes the results of prior art investigations involving transition metal-metalloid glasses and the experimental test conditions. The performance of an electrocatalyst in Table 1 has been summarized in terms of two principle parameters: (i) the Tafel slope, $\beta_i$, and (ii) the logarithm of the exchange current density, log $i_o$. The exchange current density is equivalent to the reversible rate of a reaction at equilibrium at the standard half-cell or redox potential. The Tafel slope refers to the slope of the line representing the relation between overpotential and the rate of a reaction reflected as current density where there exists a linearity on a semilogarithmic plot of overpotential and current density.

TABLE 1.0

Polarization Data of Ni—, Co— and Fe— Base Amorphous Metals for HER in Alkaline Solutions

| Amorphous Electrode | Solution | Temperature | log $i_0$ (A/cm$^2$) | $\beta c$ (mV/decade) | Reference |
|---|---|---|---|---|---|
| $Ni_{50}Co_{25}Si_{15}B_{10}$ | 1M KOH | 30 | 5.7 | 110, 178 | 1 |
| | | 30 | 6.5 | 90 | 2 |
| | | 50 | 10.6 | 93 | 2 |
| | | 70 | 7.6 | 127 | 2 |
| | | 90 | 7.9 | 113 | 2 |
| Surface-treated | 1M KOH | 30 | 5.4 | 91, 145 | 1 |
| $Ni_{50}Co_{25}Si_{15}B_{10}$ | 1M KOH | 30 | 5.8 | 101, 144 | 1 |
| Surface-treated | 1M KOH | 30 | 5.4 | 111, 166 | 1 |
| $Co_{50}Ni_{25}P_{15}B_{10}$ | 1M KOH | 30 | 5.4 | 124, 174 | 1 |
| Surface-treated | 1M KOH | 30 | 5.1 | 110, 173 | 1 |
| Thermally-treated and | 1M KOH | 30 | 4.0 | 100 | 3 |
| anodically oxidized | | 50 | 3.2 | 120 | 3 |
| $Ni_{5.5}Co_{90}P_{4.5}$ | | 70 | 2.8 | 120 | 3 |
| | | 90 | 2.2 | 100 | 3 |
| $Ni_{58}Co_{20}Si_{10}B_{12}$ | 1M KOH | 30 | 5.0 | 140 | 2 |
| | | 50 | 4.7 | 146 | 2 |
| | | 70 | 4.7 | 155 | 2 |
| | | 90 | 4.3 | 145 | 2 |
| $Co_{28}Ni_{10}Fe_5Si_{11}B_{16}$ | 1M KOH | 30 | 4.6 | 174 | 2 |
| | | 50 | 5.5 | 119 | 2 |
| | | 70 | 5.4 | 120 | 2 |
| | | 90 | 5.3 | 128 | 2 |
| $Fe_{60}Co_{20}Si_{10}B_{10}$ | 1M KOH | 25 | 6.0 | 95 | 4 |
| | | 30 | 4.2 | 128 | 2 |
| | | 50 | 4.3 | 140 | 4 |
| | | 50 | 3.7 | 125 | 2 |
| | | 70 | 3.0 | 132 | 2 |
| | | 75 | 3.6 | 150 | 4 |
| | | 90 | 2.7 | 166 | 2 |
| Anodically oxidized | | 70 | 3.4 | 138 | 5 |
| Anodically oxidized | | 70 | 2.6–3.0 | 71–99 | 5 |
| * | | 70 | 2.2–3.3 | 69–104 | 5 |
| $Ni_{70}Mo_{20}Si_{B5}$ | 1M KOH | 30 | 4.1 | 165 | 2 |
| | | 70 | 3.8 | 106 | 2 |
| | | 90 | 3.6 | 276 | 2 |
| $Fe_{39}Ni_{39}Mo_2Si_{12}B_8$ | 1M KOH | 30 | 5.0 | 123 | 2 |
| | | 50 | 4.8 | 150 | 2 |
| | | 70 | 4.9 | 173 | 2 |
| | | 90 | 4.9 | 167 | 2 |
| $Ni_{78}Si_8B_{14}$ | 1M KOH | 25 | 6.0 | 140 | 4 |
| | | 30 | 6.1 | 102 | 2 |
| | | 50 | 4.3 | 150 | 4 |
| | | 50 | 4.4 | 144 | 2 |
| | | 70 | 4.9 | 130 | 2 |
| | | 75 | 3.8 | 125 | 4 |
| | | 90 | 4.4 | 148 | 2 |
| Anodically oxidized | 30% KOH | 70 | 2.9 | 130 | 5 |
| $Fe_{40}Ni_{40}B_{20}$ | 1M KOH | 30 | 3.9 | 174 | 2 |
| | | 50 | 3.8 | 184 | 2 |
| | | 70 | 4.3 | 230 | 2 |
| | | 90 | 3.0 | 188 | 2 |
| $Fe_{78}Si_{11}B_{11}$ | 1M KOH | 30 | 4.8 | 137 | 2 |
| | | 50 | 3.8 | 187 | 2 |
| | | 70 | 3.2 | 222 | 2 |
| | | 90 | 3.9 | 134 | 2 |
| $Ni_{66.5}Mo_{23.5}B_{10}$ | 0.5M NaOH | 25 | 5.6 | 120 | 6 |
| $Ni_{56.5}Mo_{23.5}Fe_{10}B_{10}$ | 0.5M NaOH | 25 | 5.3 | 100 | 6 |
| $Ni_{56.5}Mo_{23.5}Cr_{10}B_{10}$ | 0.5M NaOH | 25 | 5.0 | 135 | 6 |
| $Ni_{70}P_{20}C_{10}$ coating | 1M NaOH | 25 | 6.2–8.4 | 65–95 | 7 |

The electrodes described in Table 1 contain various combinations of the transition metals (Ni, Fe, Co) but none for the ternaries Ni—Co—B and Ni—Mo—B for low levels of Co and Mo. None of these systems incorporates the quaternary. Ni—Co—Mo—B.

DETAILED DESCRIPTION OF THE PREFERRED EMBODIMENTS OF THE INVENTION

In order that the invention may be better understood preferred embodiments will now be described by way of example only, with reference to the accompanying drawings, wherein.

EXPERIMENTAL

Electrode metallic glass materials were prepared as follows having the nominal composition:

EXAMPLE 1

This Example illustrate the preparation electrodes having an nominal composition:

$Ni_{72}Co_{8-x},Mo_xB_{20}$ for x=0,2,4 or 6 at. %

A series of processing trials were performed to fabricate amorphous alloy ribbons by the melt-spinning technique. The process was divided into two steps. The first step was termed "pre-melting" where a powder mixture of pure materials, i.e., nickel, cobalt, molybdenum and boron, was charged into a quartz crucible and melted in a high vacuum chamber. The second step employed a boron nitride ceramic crucible which enabled the pre-melted button to be remelted and superheated to a temperature higher than 1400° C. in the vacuum chamber. A stream of molten metal was then blown through a thin slit of the ceramic crucible on to the peripheral surface of a massive copper-beryllium wheel rotating at a high speed. Rapid-quenching took place on the cold surface of the wheel, and the solidified deposit was produced in the form of thin ribbons. A concise description of amorphous metal production is given in the following subsections.

Apparatus

Melt-Spinner: D-7400 Tübingen, Edmund Bühler, Germany $3.3\times10^{-2}$ pascal High Vacuum Chamber Induction Heater: TOCCOTRON 2EG 103. The Ohio Crankshaft Co., U.S.A. Maximum output 10 kw, 450 kHz Pyrometer: Model ROS-SU, Capintec Institute Inc., U.S.A.

Figure 1:
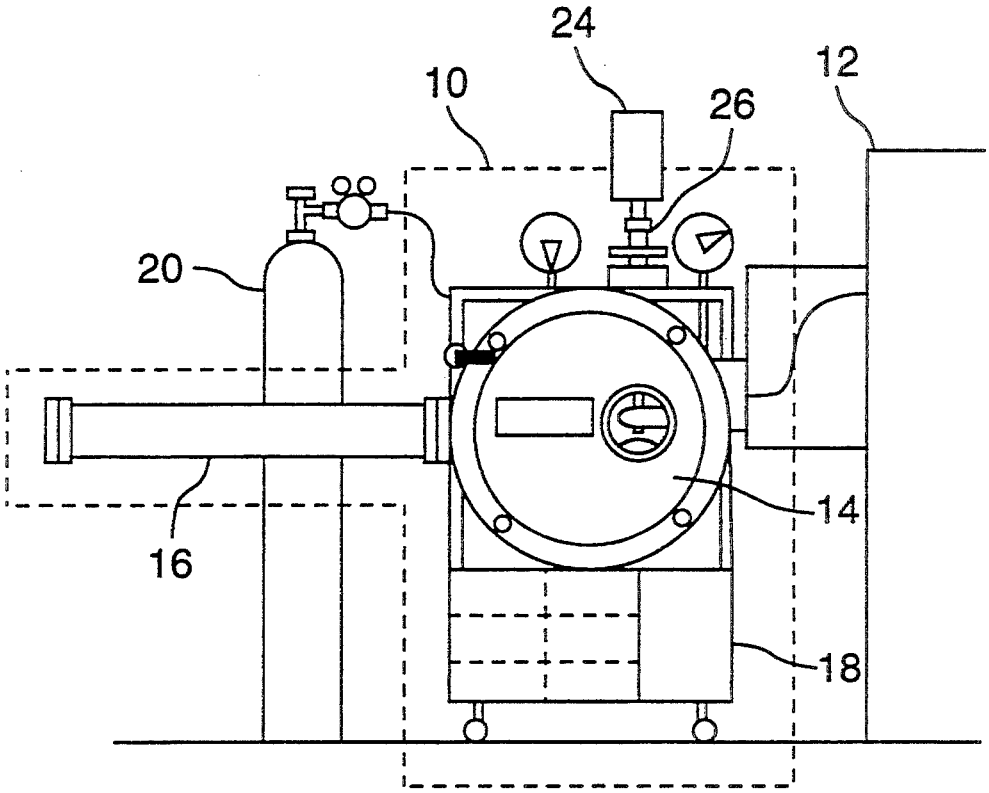
FIG. 1 is a schematic diagram of an apparatus for making a metallic glass according to the invention.

FIG. 1 illustrates the experimental apparatus consisting of a melt-spinner shown generally as 10 and an induction heating unit shown generally as 12. The melt-spinner assembly 10 comprised a high vacuum chamber 14, a ribbon collector tube 16, and a controller 18. The vacuum chamber 14 was connected to an argon cylinder 20 which supplied argon gas for purging the chamber 14 and pressurizing a ceramic crucible 22 (FIG. 2) in order to eject a molten mass of liquid material (not shown). The temperature of the molten mass of liquid in ceramic crucible 22 is measured by means of an optical pyrometer 24 attached to a quartz window 26 located above vacuum chamber 14.

Induction heater unit 12 was comprised of an induction heater coil 28 (FIG. 2) in vacuum chamber 14, a 3-stage step-up transformer and a closed-loop water recirculator (not shown) which supplied cooling water through the induction coil during heating.

Figure 2:
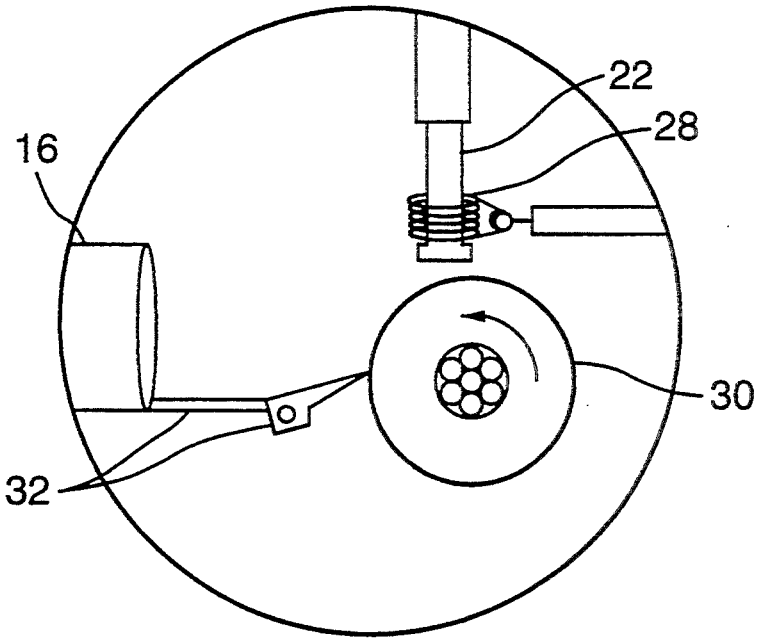
FIG. 2 is a schematic diagram detailing the interior of the vacuum chamber of the apparatus shown in FIG. 1.
Figure 3:
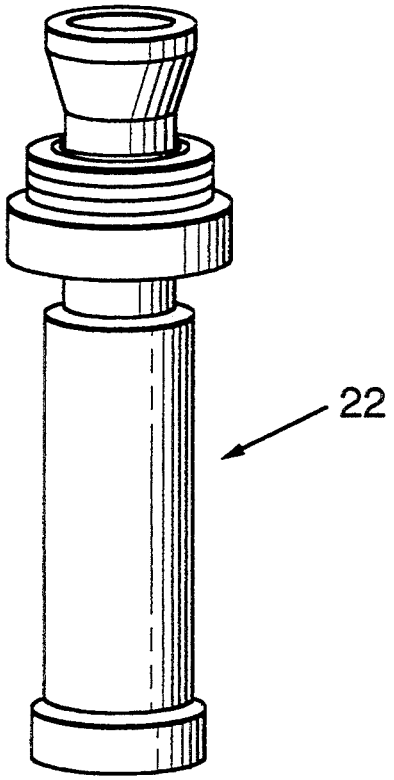
FIG. 3 is a perspective representation of a boron nitride ceramic crucible of use in the apparatus of FIG. 1.

FIG. 2 shows the arrangement of a copper-beryllium wheel 30 (8 to 10 atomic % of Be, 20 cm in diameter, 3.8 cm in width), ceramic crucible 22 induction coil 28 in high vacuum chamber 14 and ribbon guide 32.

A: Premelting

The targeted chemical compositions exemplified are collectively expressed as $Ni_{72}CO_{8-x},Mo_xB_{20}$ for x=0 to 6. Because the compositional range of the alloys is relatively small, careful sample preparation was required to ensure an effective comparison in subsequent electrochemical measurements. In order to achieve the targeted compositions with high accuracy, pure material powders were utilized to fabricate pre-melted buttons by vacuum induction melting. In the exemplified powders each mixture contained 72 atomic % nickel and 20 atomic % of boron. The remaining 8 atomic % was made up with molybdenum or cobalt and molybdenum, whose concentrations ranged from 0 to 6 atomic % Mo in increments of 2 atomic %. One third of the total boron was added in the form of nickel boride which acted as a melting point depressant and enabled the whole powder mixture to start melting at a relatively low temperature, ca 1035° C. The powder ingredients utilized are given in Table 2.

Table 2: Raw Material Constituents

Nickel: 99.9%, Spherical, 20 to 45 μm in diameter, AESAR

Cobalt: 99.9985%, Puratronic, ≦22 mesh, AESAR

Molybdenum: 99.999%, Puratronic, Powder, AESAR

Boron: 99.5%, ≦1 mm, AESAR

Nickel Boride: 99%, Granules, ≦35 mesh, AESAR

A batch of 20 to 30 g of the powder mixture was charged into a quartz crucible (I.D.=19.05 mm, O.D.=22.2 mm, height=130 mm, with round bottom). The quartz crucible was mounted in the vacuum chamber of the melt-spinner and centered in the induction coil. The vacuum chamber was then purged three times with argon and evacuated to ca. $5\times10^{-4}$ torr ($7\times10^{-2}$ Pa) before heating. The material powder mixture was melted at ca. 1200° C. in the quartz crucible. The weight loss ratio of materials through pre-melting was found to be 0.95±0.33%.

B: Melt Spinning

The melt spinner used in this work was an experimental sized model manufactured by Edmund Bühler GMBH capable of processing in both mode 5–100 gram samples of alloy mixtures. The melt-spinner assembly comprised a high vacuum chamber, a ribbon collector tube, and a motor speed controller. The induction heater unit was comprised of an induction heater coil in the vacuum K, Na, Si, Sb. Expected concentrations of Ni, Co, Mo and B in the standard and sample solutions are summarized in Table 4.

TABLE 4

Summary of Expected Concentrations of ICP Samples (ppm)

| Serial No. | Solute | Ni | Co | Mo | B |
|---|---|---|---|---|---|
| #1 | Standard (1) | 29.98 | 30.00 | 30.00 | 5.52 |
| #2 | Standard (2) | 9.99 | 10.00 | 10.00 | 1.84 |
| #3 | Standard (3) | 1.00 | 1.00 | 1.00 | 0.18 |
| #4 | $Ni_{72}Co_6Mo_2B_{20}$ head | 29.91 | 2.50 | 1.36 | 1.53 |
| #5 | $Ni_{72}Co_6Mo_2B_{20}$ tail | 29.99 | 2.51 | 1.36 | 1.53 |
| #6 | $Ni_{72}Co_6Mo_2B_{20}$ centre | 29.99 | 2.51 | 1.36 | 1.53 |
| #7 | Standard (4) | 29.97 | 2.50 | 1.36 | 1.53 |
| #8 | $Ni_{72}Co_4Mo_4B_{20}$ head | 30.47 | 1.70 | 2.77 | 1.56 |
| #9 | $Ni_{72}Co_4Mo_4B_{20}$ tail | 30.19 | 1.68 | 2.74 | 1.54 |
| #10 | $Ni_{72}Co_4Mo_4B_{20}$ centre | 30.47 | 1.70 | 2.77 | 1.56 |
| #11 | Standard (5) | 29.99 | 1.67 | 2.72 | 1.54 |
| #12 | $Ni_{72}Co_2Mo_6B_{20}$ head | 29.58 | 0.83 | 4.03 | 1.51 |
| #13 | $Ni_{72}Co_2Mo_6B_{20}$ tail | 29.54 | 0.82 | 4.02 | 1.51 |
| #14 | $Ni_{72}Co_2Mo_6B_{20}$ centre | 29.54 | 0.82 | 4.02 | 1.51 |
| #15 | Standard (6) | 30.00 | 0.84 | 4.09 | 1.54 |
| #16 | $Ni_{72}Mo_8B_{20}$ head | 30.01 | 0 | 5.45 | 1.54 |
| #17 | $Ni_{72}Mo_8B_{20}$ tail | 30.01 | 0 | 5.45 | 1.54 |
| #18 | $Ni_{72}Mo_8B_{20}$ centre | 30.01 | 0 | 5.45 | 1.54 |
| #19 | Standard (7) | 30.00 | 0 | 5.45 | 1.53 |
| #20 | 100 ppm Ni | 100 | 0 | 0 | 0 |
| #21 | 100 ppm B (Boric Acid) | 0 | 0 | 0 | 100 |
| #22 | Blank (1) | 0 | 0 | 0 | 0 |

TABLE 4-continued

| Summary of Expected Concentrations of ICP Samples (ppm) | | | | | |
|---|---|---|---|---|---|
| Serial No. | Solute | Ni | Co | Mo | B |
| #23 | Blank (2) | 0 | 0 | 0 | 0 |

The chemicals used for preparation of the digesting solution are listed below.

Nitric acid: Minimum assay 70.5%, Analytic reagent, J. T. Baker Inc.

Hydrochloric acid: Minimum assay 35.4%, Analytic reagent, BDH Inc.

Boric acid: 99.8%, Analytic reagent, BDH Inc.

The sixth evaluation relates to an assessment of preferential Mo dissolution from the alloy when cycled from strongly anodic (oxygen evolution) to strongly cathodic (hydrogen evolution) conditions.

The seventh evaluation refers to the examination of the surface of the electrode materials used under both constant potential and conditions of potential cycling as described above.

The first test was performed in order to obtain reliable information on the elemental composition of the amorphous alloys using inductively coupled plasma spectroscopy (ICP). Although only a very small weight loss, 0.95 weight %, was found during the premelting operation, if the loss was due to a single component, inaccuracies in the targeted compositions would result. Additionally, there was concern about any compositional fluctuation in the longitudinal direction of the amorphous ribbon. For this reason, three positions designated as head, center and tail were taken from each ribbon and analyzed. ICP is a technique which provides a quantitative analysis of almost all elements with a high level of detectability.

The technique requires that the sample to be analyzed is dissolved in an aqueous solution because the sample is introduced to the inductively coupled plasma in the form of an aerosol. Each amorphous ribbon was dissolved into concentrated nitric acid and diluted with water and hydrochloric acid to complete the designated matrix solution which contained 4 weight % $HNO_3$ and 4 weight % HCl. For experimental error analysis, some standard solutions were prepared with pure material powders. In order to determine the presence of any interference of nickel and boron on the analysis of the remaining elements, high concentration samples such as 100 ppm nickel and 100 ppm boron (using boric acid), were also added to some samples. ICP measurements were carried out three times for each sample solution by Ortech International, Ontario, Canada. The major elements analyzed were Ni, Co, Mo, and B as well as other trace elements such as Al, As, Ca, Cd, Cr, Cu, Fe, Mg, Mn, P, Pb, S, Se, Ti, V, Zn, chamber, a 3-stage step-up transformer, and a closed-loop water recirculator which supplied cooling water through the induction coil during heating. The vacuum chamber was connected to an argon cylinder which supplied gas for purging the chamber and pressurizing the ceramic crucible in order to eject a molten mass of liquid. The temperature of the molten mass of liquid in the ceramic crucible was measured by means of an optical pyrometer which was attached to a quartz window located above the vacuum chamber.

One or two pre-melted buttons were charged into the BN ceramic crucible. Boron nitride has the advantages of high hardness at elevated temperatures and good oxidation resistance which enabled the molten liquid to be superheated to over 1400° C. without any chemical reaction with the crucible.

The crucible was mounted above the Cu-Be wheel in the vacuum chamber. The chamber was purged and evacuated in the same manner as that described during premelting. The pre-melted button(s) was superheated in the crucible by the induction coil until the liquid temperature reached a stable maximum temperature which was dependent on the alloy composition. The molten mass of liquid was ejected by argon pressure on to the wheel through a fine slit nozzle (0.5×15 mm). Planar amorphous ribbons were formed on the surface of the wheel rotating counterclockwise and driven along the ribbon guides to the collector tube. This particular form of melt spinning is referred to as the planar flow casting technique. From the wheel rotation speed, a quenching rate was estimated to be ca $10^6$° C./sec. One side of the ribbon was free from contact with the wheel and had a shiny appearance (shiny side) compared with the dull appearance for the other side in contact with the wheel (wheel side). To minimize surface imperfections on the dull side due to contact with the wheel, the peripheral surface of the wheel was thoroughly polished with diamond paste and degreased with acetone before each run. Standard experimental parameters of the melt-spinning operation are summarized in Table 3.

TABLE 3

| Summary of Operational Parameters of Melt-Spinning | |
|---|---|
| Clearance between the bottom most edge of the crucible and the wheel surface | 0.5 mm |
| Point of impingement | 12 degrees counterclockwise from the top of the wheel |
| Pre-melt button weight | 20 to 60 g |
| Vacuum chamber pressure | $7 \times 10^{-2}$ Pa or lower |
| Molten ejection pressure | 40 kPa |
| Wheel rotation speed | 2485 rpm (tangential linear velocity: 26 m/sec) |
| Superheat temperature | higher than 1400° C. |

The alloys of the invention so produced by planar flow casting were submitted to the following further types of evaluation.

The first evaluation relates to the actual composition of the alloys produced as poor recoveries during melting can produce substantial deviations between the nominal and actual composition of a given alloy.

The second evaluation relates to the structure of the alloys produced as the processing method produces a metastable structure which is amorphous or nanocrystalline in nature.

The third evaluation relates to the electrode performance in relation to the overvoltage necessary for hydrogen production for as-melt spun ribbons under conditions related to the electrolysis of an alkaline solution.

The fourth evaluation relates to the electrode performance in relation to stability when cycled from strongly anodic (oxygen evolution) to strongly cathodic (hydrogen evolution) conditions.

The fifth evaluation relates to the electrode performance in relation to the overpotential necessary for hydrogen production for potentially cycled melt spun ribbons under conditions related to the electrolysis of an alkaline solution.

The seond test was performed using the technique of X-ray diffraction in order to confirm the degree of crystallinity of the manufactured ribbons. For comparison, measurements were also carried out on crystallized fragments of the amorphous alloys as well as pure elemental nickel, cobalt, molybdenum, boron and the intermetallic nickel boride. The amorphous samples were prepared by cutting ribbons into 4 mm×10 mm rectangular pieces. They were mechanically ground with 600 grit SiC and polished to a 1 μm finish with diamond paste. The samples were then degreased with acetone, methanol and deionized water in sequence. The crystallized fragments had the same bulk composition as the corresponding amorphous alloy and were primarily in the form of brittle plate-like powder. To avoid preferential diffraction due to the plate-like surface of the fragments, the crystallized amorphous alloy was ground to form a fine powder in an agate mortar and dispersed on a slide glass before measurement. Diffraction patterns were measured on a Philips Type PW-1120/60 X-ray diffractometer using 40 kV Cu-$K_a$ radiation with a Ni filter in the range of 10 to 90 degree-2$\theta$ at a scan rate of 2 degree-2$\theta$ per minute.

The third test involved determining the electrochemical overpotential for hydrogen evolution by determination of the Tafel slope and exchange current density for the alloys produced above. Working electrodes were prepared from the Ni—Co—Mo—B amorphous alloy ribbons of ca. 30 μm thickness and 4 to 15 mm in width. The shiny side of the ribbon was ground, polished, and degreased. The as-polished ribbon was cut into approximately 3 mm×25 mm pieces, and each piece was soldered to an insulated copper lead. The soldered area, unpolished wheel side, and periphery of the polished side were thoroughly coated three times at 24 hr intervals by Amercoat 90® epoxy resin. This masking coat resists either alkaline or acidic environments. The exposed geometrical surface area of the fabricated electrodes ranged from 0.01 to 0.22 $cm^2$, and typically from 0.02 to 0.07 $cm^2$.

Figure 4:
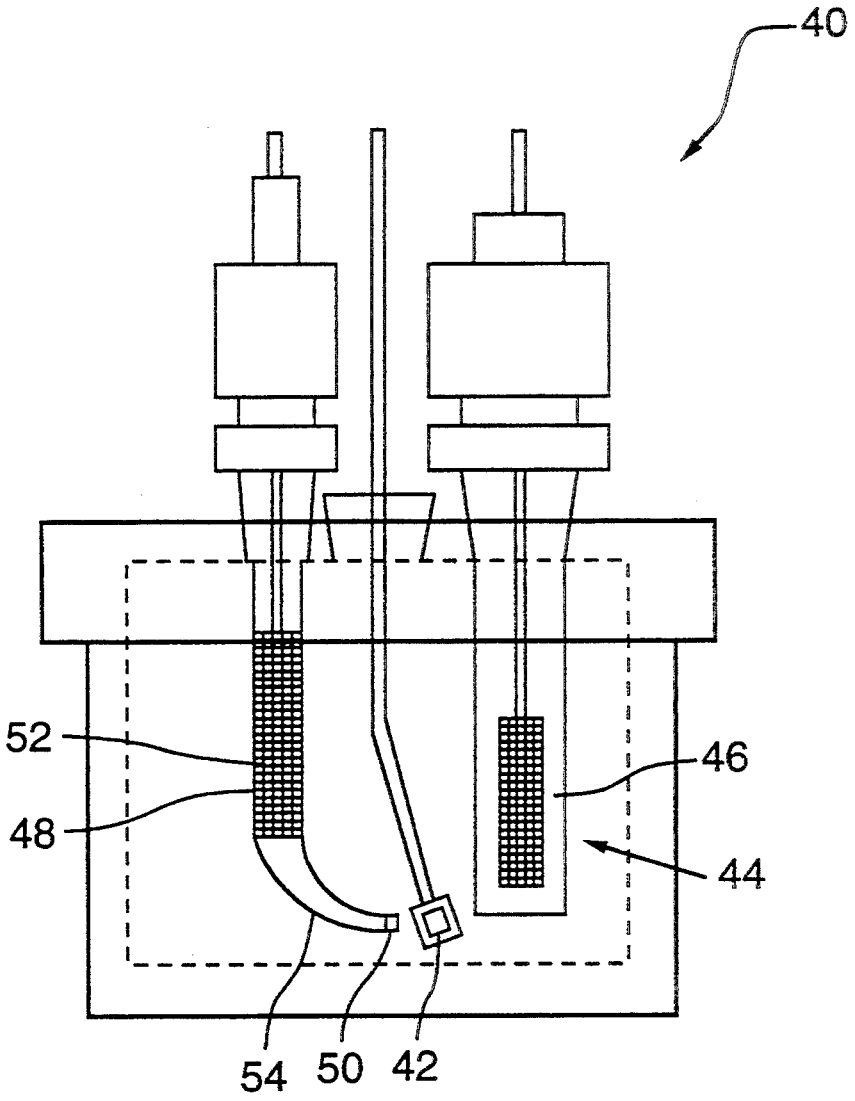
FIG. 4 is a schematic diagram of a three component cell used in the evaluation of the electrochemical activity and stability of the materials according to the invention.
Figure 5:
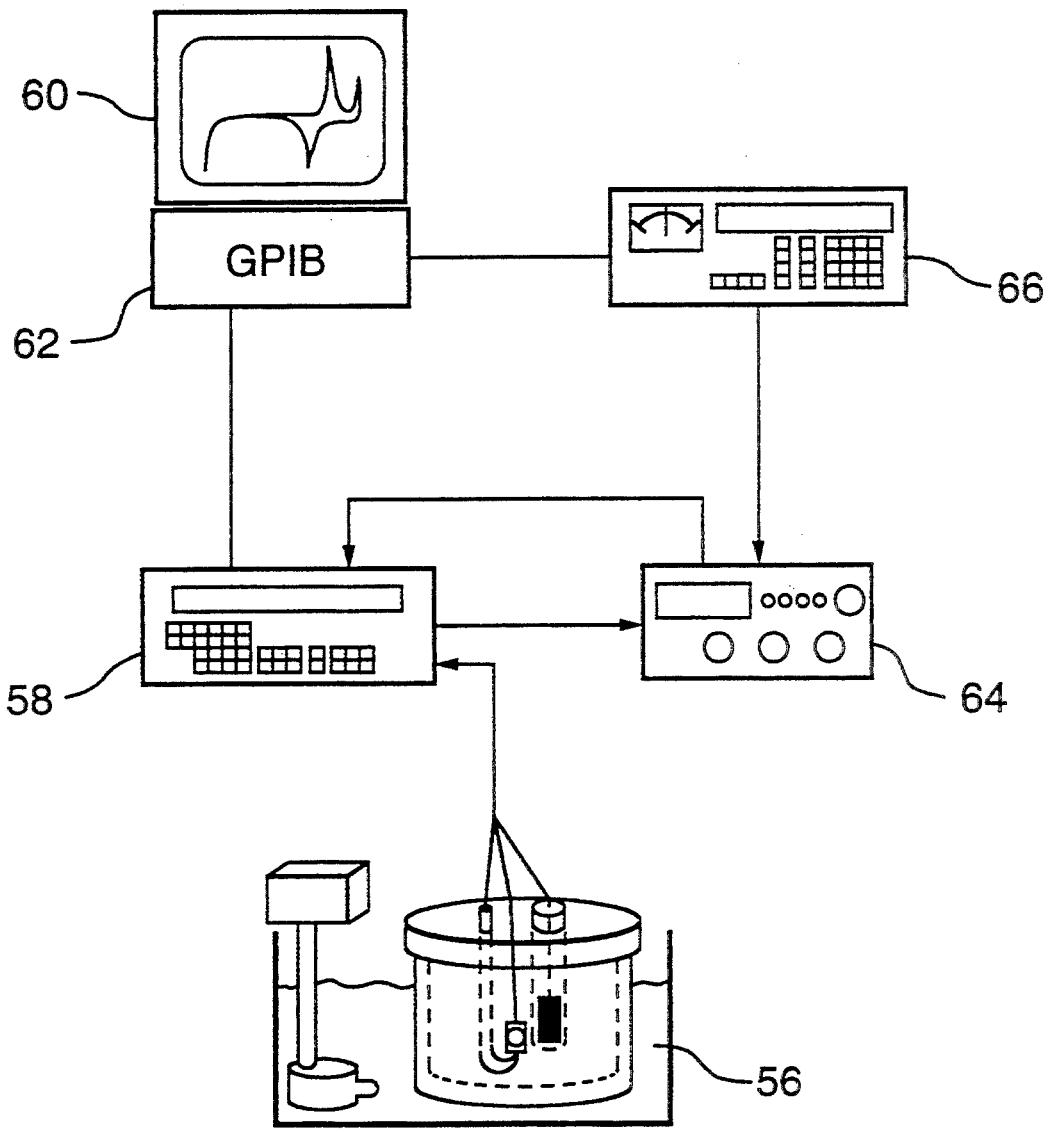
FIG. 5 is a diagrammatic representation of the apparatus of use in obtaining electrochemical measurements, and wherein the same numeral denotes like parts.

The electrolytic cell shown in FIG. 4 generally as 40 had a three-compartment structure consisting of a 300 ml capacity main body formed of Teflon® containing a working electrode 42 of the ribbon of alloy of the invention, a ½" Teflon® tube 44 housing a counter electrode 46, and a ¼" Teflon PTFE tube filled with mercury-mercuric oxide paste (Hg/HgO) 48. The compartments were separated by electrolyte-permeable membranes 50 in the form of a diaphragm or frit. The counter electrode 46 was a 25 mm×12.5 mm platinum gauze with a surface area of ca. 4.4 $cm^2$. The Hg/HgO paste in aqueous 1M KOH solution was used as a reference electrode 52. The tip 54 of a Luggin capillary of the reference electrode compartment was placed a distance of ca. 2 mm to the working electrode surface of the alloys of the invention. All potentials quoted herein are referred to the Hg/HgO electrode in 1M KOH solution at 30° C. The electrolyte was aqueous 1M potassium hydroxide solution prepared with KOH and deionized water. The amount of KOH used in 1 L solution was 56.1083±0.0057 g. The electrolyte was replaced with fresh electrolyte and was deaerated by argon at a rate of 30 ml/min prior to each experiment. Argon bubbling was continued during the experiment. The solution temperature was controlled at 30° C. in an 18 L water bath 56 (FIG. 5) with an immersion heater (Polystat Immersion Circulator, Cole-Palmer).

The apparatus used for electrochemical measurements comprises water bath 56 in electrical contact with a potentiostat/galvanostat Hokuto Denko HA-501G with a Hewlett Packard model 319C computer 60, through a GPIB interface 62, and an Ohmic drop corrector (Hokuto Denko H1-203S) 64. An arbitrary function generator (Hokuto Denko HA-105B) 66 connects with corrector 64 and computer 60.

The electrocatalytic activity of the amorphous alloys for the hydrogen evolution reaction (HER) was studied by a quasi-steady-state polarization technique. In practice, polarization curves of the amorphous electrodes were measured under quasi-potentiostatic conditions at a very low sweep rate of 2 mV/min. This potential sweep rate was found to be the maximum sweep rate which provided reproducible steady-state measurements. The as-polished working electrode was rinsed ultrasonically with acetone, methanol, and deionized water in sequence prior to testing. The electrode was then placed in the cell with deaerated 1M KOH solution and held at a potential of −1.3 V vs. Hg/HgO for 3 hours to clean the electrode surface electrochemically. The potential was swept over the range of −0.9 to −1.5 V vs. Hg/HgO in order to assess the Tafel behaviour of the electrode response. Polarization curves were replicated at least three times for each electrode and analyzed for their reproducibility. IR-compensation was used during the polarization measurements using an AC impedance technique. A 1 kHz, 10 mV wave was superimposed by an ohmic drop corrector HI-203S on the controlling electrode potential for continuous IR-drop measurement. Potentials were simultaneously recorded in the form of IR-drop free values. The Tafel parameters were analyzed from IR-compensated polarization curves by statistical procedures.

The fourth test was performed using the potentiodynamic polarization technique. The electrochemical behaviour of the amorphous electrodes were studied by running sequential cyclic voltammetry at high potential sweep rate, 25 mV/sec, in the range from −1.3 to +0.6 V vs. Hg/HgO covering both the HER and OER potentials, −0.922 and +0.307 V vs. Hg/HgO, respectively. The potential sweep range also covered most of the equilibrium redox reaction potentials of Ni, Co and Mo. The as-polished working electrode was mounted in the cell, and the electrolyte was deaerated. After the electrolyte temperature was stabilized at 30° C., a rest potential (open-circuit potential) measurement was performed, and cyclic voltammetry was initiated. To ensure reproducibility of the response, the unit cycle was programmed to repeat 200 times, in some cases 600 times, by the arbitrary function generator. Potential and current data were taken by the potentiostat at an interval of 0.5 seconds on the first, 5th, 10th, 25th, 50th, 100th, 150th, and 200th cycles. No IR-compensation was applied.

The fifth test was performed using a repeat of the third test methodology after the electrodes had been electrochemically cycled as outlined in the fourth test. After 200 voltammetric sweeps, the cathodic polarization measurement was again performed to determine the effects of the electrochemical oxidation/reduction cycles on the activity and stability of the electrode surface.

The sixth test was performed using a coulometric experiment to study the dissolution of the amorphous electrode constituents, and in particular molybdenum. The experiment was performed at +0.1 V vs. Hg/HgO where crystalline molybdenum was found to dissolve in a 1M KOH solution. The potential was ca. 100 mV higher than the Mo dissolution peak on the voltammogram for crystalline Mo, ca. 300 mV lower than the equilibrium potential of the $Ni(OH)_2/\beta$_NiOOH redox couple for anodically polarized electrodes and ca 6 mV lower than the equilibrium potential of the $Ni(OH)_2$-/$\beta$_NiOOH redox couple for cathodically polarized or neutral electrodes. A large area of the $Ni_{72}Mo_8B_{20}$ amorphous electrode was fabricated from a 1.5 cm square ribbon piece by mechanically polishing both shiny and wheel sides to a 1 μm finish. The total exposed area was 4.5 $cm^2$. The electrode was immersed in 175 mL of dearated 1M KOH solution at 30° C. and kept at the test potential for 63 hours while measuring the current response. Current records were taken on average 5.8 times a second and accumulated over a test period. Consequently, the cumulative current was compared with the elemental concentration of Mo in the solution measured by neutron activation analysis. No IR-compensation was applied.

The seventh test was performed on amorphous alloy and crystalline surfaces to compare the degree of surface toughening and hence electrode degradation by using optical and scanning electron microscopy. Optical investigation was achieved using a light stereoscope and light metallograph. Electron imaging was accomplished using a Hitachi S-570 SEM equipped with a Link Analytical An 10/85s x-ray analyzer. Nominal imaging conditions were: accelerating voltage—20 kV, beam current—100 μA, sample tilt—15°.

In the first test a quantitative composition analysis by Inductively Coupled Plasma Spectroscopy was performed. The average experimental composition of each amorphous ribbon as determined by the ICP analysis is listed in Table 5. All of the measured compositions of the amorphous ribbons were in good agreement with the targeted compositions. An average magnitude of the deviation of the actual from the nominal composition was only ca. 0.3 atomic %. Variations of principal element concentrations were also measured at three different longitudinal positions over the ribbon such as head, center and tail. There was no significant difference in the compositions at different positions. From these data, the amorphous ribbons can be regarded as homogeneous in the longitudinal direction.

TABLE 5

| Composition of the Amorphous Ribbons (atomic %) | |
|---|---|
| Targeted Composition | Measured Composition |
| $Ni_{72}Co_6Mo_2B_{20}$ | $Ni_{72.3}Co_{5.9}Mo_{1.9}B_{20.0}$ |
| $Ni_{72}Co_4Mo_4B_{20}$ | $Ni_{72.0}Co_{4.0}Mo_{3.8}B_{20.2}$ |
| $Ni_{72}Co_2Mo_6B_{20}$ | $Ni_{72.5}Co_{2.0}Mo_{5.8}B_{19.7}$ |
| $Ni_{72}Mo_8B_{20}$ | $Ni_{73.3}Mo_{7.4}B_{19.2}$ |

In the second test, the structure of the ribbon was assessed using x-ray diffraction as it is an integral part of the electrode performance independent of the exact composition of the electrode material. It is known that a typical X-ray diffraction (XRD) pattern of an amorphous material is a broad spectrum with no prominent sharp peaks relating to crystalline structure. Thus qualitative confirmation of the amorphous nature of an alloy is demonstrated by a broad band peak in its XRD profile.

As additional information, an index, viz. effective crystallite dimension was calculated to evaluate the largest potential size of crystal embryos in the melt-spun ribbons. The effective crystahite dimension is expressed by the equation:

$$D = \frac{0.91\lambda}{\beta\cos\theta}$$

where

D is the effective crystallite dimension in nm and

λ is wavelength of the Cu-$K_a$ radiation, i.e. 0.1542 nm.

β denotes the full width of a given diffraction peak in radians at half the maximum intensity.

θ is the Bragg angle of the peak maximum. The effective crystallite dimension were measured for all the melt-spun ribbons. Results of the calculations are summarized in Table 6. The melt-spun Ni—Co—Mo—B alloys displayed very small values of the effective crystallite dimension determined from their broad band peak width in X-ray diffraction confirming the amorphous nature of the melt spun ribbons.

TABLE 6

| | Effective Crystallite Dimension | | | |
|---|---|---|---|---|
| Amorphous Alloy Composition | Peak Maximum Position 20 (°) | Apparent Mean d-Spacing d(Å) | Full Width of Half the Maximum Intensity β (rad) | Effective Crystallite Dimension D (nm) |
| $Ni_{72}Co_6Mo_2B_{20}$ | 45.5 | 1.993 | 0.138 | 1.1 |
| $Ni_{72}Co_4Mo_4B_{20}$ | 45.0 | 2.015 | 0.126 | 1.2 |
| $Ni_{72}Co_2Mo_6B_{20}$ | 45.0 | 2.015 | 0.136 | 1.1 |
| $Ni_{72}Mo_8B_{20}$ | 44.8 | 2.023 | 0.123 | 1.2 |

In the third test, the electrocatalytic performance of the various amorphous electrodes was measured and compared to the behaviour of the crystalline elemental constituents. In the potential range of −0.9 to −1.5 V vs. Hg/HgO, the current responses (polarization curves) of crystalline Ni, Co, Mo, and the amorphous Ni—Co—Mo—B alloys varied from ca. 0.001 to 1000 mA/$cm^2$, and linear correlations were found in the potential vs. logarithmic current plot (Tafel plot) which were analyzed to obtain Tafel parameters, b and $i_o$, by a statistical regression method. The Tafel slopes and exchange current densities are summarized in Table 7.

TABLE 7

| Tafel Parameters of As-Polished Electrodes for the HER in 1M KOH Solution at 30° | | | | | | | | |
|---|---|---|---|---|---|---|---|---|
| | | | | | Amorphous | | | |
| | | Crystaline | | | | | | |
| Field | Tafel parameter | Ni | Co | Mo | $Ni_{72}Co_6Mo_2B_{20}$ | $Ni_{72}Co_4Mo_4B_{20}$ | $Ni_{72}Co_2Mo_6B_{20}$ | $Ni_{72}Mo_8B_{20}$ |
| Low field | −E* | 0.97 to 1.25 | 1.1 to 1.27 | — | 0.95 to 1.44 | 1.15 to 1.25 | 1.05 to 1.48 | 1.0 to 1.5 |
| | $-\log i_o$** | 4.5 ± 0.02 | 4.7 ± 0.03 | — | 5.0 ± 0.05 | 6.2 ± 0.1 | 6.0 ± 0.07 | 4.2 ± 0.02 |
| | −ηc*** | 120 ± 1 | 130 ± 1 | — | 147 ± 2 | 110 ± 5 | 114 ± 3 | 175 ± 1 |
| High field | −E | 1.25 to 1.56 | 1.25 to 1.44 | 1.2 to 1.4 | | 1.25 to 1.5 | | |
| | $-\log i_o$ | 3.2 ± 0.3 | 4.00 ± 0.1 | 6.6 ± 0.2 | — | 5.7 ± 0.05 | — | — |

TABLE 7-continued

Tafel Parameters of As-Polished Electrodes for the HER in 1M KOH Solution at 30°

| | | Crystaline | | | Amorphous | | | |
|---|---|---|---|---|---|---|---|---|
| Field | Tafel parameter | Ni | Co | Mo | $Ni_{72}Co_6Mo_2B_{20}$ | $Ni_{72}Co_4Mo_4B_{20}$ | $Ni_{72}Co_2Mo_6B_{20}$ | $Ni_{72}Mo_8B_{20}$ |
| | $-\eta c$ | 239 ± 14 | 178 ± 4 | 90 ± 4 | | 132 ± 2 | | |

*Potential range (V vs. Hg/HgO),
**Exchange current density (A/cm$^2$),
***Tafel slope (mV/decade), Appreciable differences in the current density values were clearly observed as a function of the compositions of the amorphous alloys. The following ranking of the electrocatalytic activity was found:

$$Ni_{72}Mo_8B_{20} > Ni_{72}Co_6Mo_2B_{20} > Ni_{72}Co_2Mo_6B_{20} > Ni_{72}Co_4Mo_4B_{20}$$

This ranking order does not simply follow the order of the Mo/Co content ratio in the amorphous alloys. Both $Ni_{72}Co_4Mo_4B_{20}$ and $Ni_{72}Co_2Mo_6B_{20}$ showed inferior activity relative to other two amorphous alloys and showed similar Tafel slope values of 110 and 114 mV/decade, respectively, as shown in Table 8. The highest electrocatalytic activity of $Ni_{72}Mo_8B_{20}$ amongst the amorphous alloys could possibly be attributed to the synergetic effect of Ni—Mo which may influence the particularly large Tafel slope value of this amorphous alloy.

The activity of the electrodes and the electrode stability were evaluated in the fourth and fifth tests after the electrodes were subjected to extreme conditions of cycling of the electrochemical cell between the hydrogen and oxygen evolution reactions. It is well known that surface activation treatments are often required to optimize the electrocatalytic activity of an electrode. Sequential potential cycling was applied in the present study to modify the amorphous electrode surface because the SEM examination proved the amorphous surface would not be roughened by this treatment. This was not true in the case of crystalline alloys which are severely roughened by this treatment. Table 8 summarizes the Tafel parameters. As compared with Table 7, all amorphous alloys showed significant improvement in the current density values showing potential cycling to be an effective method of electrode activation. The potential cycled $Ni_{72}Mo_8B_{20}$ alloy exceeded the activity of as-polished Ni in the low field ($> -1.15$ V vs. Hg/HgO) region. Although the activity of the alloys in. Table 8 may not be as high as some iron containing amorphous alloys in Table 2, the latter display long term dissolution in alkaline environments and are thus unsuited for many water electrolysis applications.

TABLE 8

Tafel Parameters of Potential Cycled Electrodes for the HER in 1M KOH Solution at 30°

| | | Crystaline | | Amorphous | | | |
|---|---|---|---|---|---|---|---|
| Field | Tafel parameter | Ni | Mo | $Ni_{72}Co_6Mo_2B_{20}$ | $Ni_{72}Co_4Mo_4B_{20}$ | $Ni_{72}Co_2Mo_6B_{20}$ | $Ni_{72}Mo_8B_{20}$ |
| Low field | $-E$* | 1.06 to 1.25 | 1.15 to 1.3 | 1.06 to 1.25 | 1.0 to 1.5 | 1.0 to 1.5 | 0.94 to 1.55 |
| | $-\log i_o$** | 3.8 ± 0.04 | 6.6 ± 0.1 | 5.3 ± 0.07 | 5.1 ± 0.03 | 5.1 ± 0.07 | 4.0 ± 0.04 |
| | $-\eta c$*** | 149 ± 2 | 79 ± 3 | 109 ± 3 | 148 ± 2 | 142 ± 3 | 180 ± 2 |
| High field | $-E$ | 1.25 to 1.56 | 1.3 to 1.46 | 1.25 to 1.5 | | | |
| | $-\log i_o$ | 3.3 ± 0.1 | 5.0 ± 0.3 | 4.4 ± 0.1 | — | — | — |
| | $-\Theta c$ | 308 ± 9 | 122 ± 7 | 170 ± 6 | | | |

*Potential range (V vs. Hg/HgO),
**Exchange current density (A/cm$^2$),
***Tafel slope (mV/decade).

The electrode stability was-evaluated in the sixth test after the electrode was subjected to an extended exposure in 1M KOH in a potential regime that is favourable for Mo dissolution. The cyclic voltammetry study for crystalline Mo revealed its tendency to actively dissolve in 1M KOH solution at a high dissolution rate. Mo dissolution has been observed to occur from the nanocrystalline surface of Mo—doped Raney nickel [R. Henne, A. Kayser, V. Borck and G. Schiller, Proc. Int. Thermal Spray Conf., Orlando Fla., p. 817-824, (1992)] and electrodeposited Ni—Mo coating [J. Divisek, H. Schmitz and J. Balej, J. of Applied Electrochemistry, 19, p. 519-530, (1989)] in alkaline solutions. However, none of the voltammograms of the amorphous Ni—Co—Mo—B alloys manufactured in the present invention showed a peak corresponding to the Mo dissolution current peak observed on pure crystalline Mo. The coulometry experiment was coupled with neutron activation analysis of the KOH solution. If an appreciable current is observed, it must be attributable to Mo dissolution and/or the Ni / $Ni(OH)_2$ oxidation reaction. The description of the sample electrode, KOH solution and current data acquisition is summarized in Table 9.

TABLE 9

Experimental Conditions for the Coulometry Experiment

| | |
|---|---|
| Sample Electrode | |
| Material | Amorphous $Ni_{72}Mo_8B_{20}$ Alloy |
| Exposed Area | 4.50 cm$^2$ (both-sided polished) |
| Solute | 1M KOH, 5.61 weight % of KOH |
| Concentration | 3.91 weight % K |
| Solution (aqueous) | |
| Impurities | 280 ppm Na |
| pH | 13.71 |
| Temperature | 30° C. |
| Total Volume | 175 mL |
| Current Data Sampling | |
| Interval | ca. 5.8 times/sec on an average |
| Period of Time | 63 hr 3 min 20 sec (227,000 sec) |

The resulting cumulative current was $Q=140.2\times10^{-3}$ C (coulomb). Assuming that only Mo dissolution occurred, the Mo concentration was calculated with the following expression:

$$C_{Mo}(\text{ppm}) = \frac{10^6(\text{ppm mL g}^{-1})\, M_w(\text{g mole}^{-1})Q(C)}{V(\text{mL})\, Z_{Mo}F(C\ \text{mole}^{-1})} = \frac{10^6 \times 95.94 \times 150.2 \times 10^{-3}}{175 \times 6 \times 96{,}486.7}$$

$$C_{Mo}(\text{ppm}) = 0.142$$

Where $M_w$ is the atomic weight of Mo, $C_{Mo}$ is the concentration of Mo in the KOH solution, $Z_{Mo}$ is the valence of Mo in the form of molybdate ion, $MoO_{42-}$, and F is Faraday's constant.

Neutron activation analysis (NAA) was employed to determine the experimental Mo concentration in the KOH solution used in the coulometric experiment. Two samples were taken from the KOH solution after the coulometry experiment and analyzed for their elemental Mo, Ni, B, K and Na concentrations. The resulting Mo, Ni and B concentrations were under the detection limit of the analyzer, 21 ppb, as shown in Table 10. Since reasonable concentration values were obtained for K and Na, the negligible concentration of Mo shows that Mo dissolution did not contribute substantially to the measured current during the coulometry experiment.

TABLE 10

Concentration of Elements in the Coulometry Solution

| Element | Sample 1 | Sample 2 |
|---|---|---|
| Mo | <21 ppb | <21 ppb |
| Ni | | |
| B | | |
| K | 4.1 weight % | 4.3 weight % |
| Na | 290 ppm | 300 ppm |

In the seventh test, in order to obtain additional information on the condition of the electrode surface after 200 or 600 cycles of the sequential cyclic voltammetry, specimens were examined using optical and scanning electron microscopy (SEM). It was found that the potential cycled crystalline Ni, Co and Mo electrodes had thick corrosion product layers. Crystalline Ni electrodes after 200 and 600 cycles showed a growth in the corrosion layer with potential cycling. The crystalline Co electrode showed a sign of crystallization / dissolution reactions by polygon-plate-like uniform deposits on the electrode surface. The crystalline Mo electrode showed a severely corroded surface and a remaining skeleton structure which indicated the active dissolution of Mo. All crystalline electrodes showed much higher roughness than their as-polished state.

In contrast, potential cycled amorphous electrodes showed very smooth surfaces and no indication of corrosion. Only a slight surface layer (probably Ni oxides) could be seen characterized by a dull transparent film which covered the very smooth surface of the amorphous alloys. No significant difference was found between the amorphous electrodes potential cycled 200 and 600 times. Hence after exposure to severe potential cycling conditions, the amorphous alloy electrodes were more stable than the crystalline electrodes of the elements Ni, Co or Mo.

Although this disclosure had described and illustrated certain preferred embodiments of the invention, it is to be understood that the invention is not restricted to these particular embodiments. Rather, the invention includes all embodiments which are functional or mechanical equivalents of the specific embodiment and features that have been described and illustrated.

We claim:

1. A metallic glass of use in electrochemical processes, said metallic glass consisting essentially of a material of the general nominal composition $$Ni_{72}\, Co_{8-x}\, Mo_x\, Z_{20}$$

wherein x is 0,2,4,6 or 8 atomic % and

Z is a metalloid element.

2. A metallic glass as claimed in claim 1 wherein x is 2, 4 or 6 atomic %.

3. A metallic glass as claimed in claim 1 wherein said metalloid element is selected from the group consisting of boron, silicon, phosphorus and carbon.

4. A metallic glass as claimed in claim 3 wherein said metalloid element is boron.

5. A metallic glass as claimed in claim 1 which is substantially homogeneous.

6. A metallic glass as claimed in claim 1 wherein said Ni, Co, Mo and Z are in a substantially elemental state.

7. A metallic glass a claimed in claim 1 consisting essentially of a material having the nominal composition of $Ni_{72}\, Mo_8\, B_{20}$.

8. A metallic glass a claimed in claim 1 consisting essentially of a material having the nominal composition of $Ni_{72}\, Co_8\, B_{20}$.

9. An electrode for use in an electrochemical cell comprising a metallic glass consisting essentially of a material as claimed in claim 1.

10. An electrode as claimed in claim 9 comprising a support and on at least a portion of said support a coating comprising said metallic glass.

11. An electrode as claimed in claim 9 in the form of a self supporting structure.

12. An electrode as claimed in claim 9 wherein said electrochemical cell is for the electrochemical production of oxygen and hydrogen from an aqueous solution.

13. An improved process for the electrochemical production of oxygen and hydrogen from an aqueous solution in an electrochemical cell, said process comprising electrolysing said aqueous solution with electrodes, said improvement comprising one or more of said electrodes comprising a metallic glass consisting essentially of a material as claimed in claim 1.

* * * * *